US007059477B2

(12) United States Patent
Wolf, II et al.

(10) Patent No.: US 7,059,477 B2
(45) Date of Patent: Jun. 13, 2006

(54) BARTENDER'S TIP JAR

(76) Inventors: Thomas A. Wolf, II, 820 Overland Dr., Lowry Crossing, TX (US) 75069; Daniella M. Wolf, 820 Overland Dr., Lowry Crossing, TX (US) 75069

( * ) Notice: Subject to any disclaimer, the term of this patent is extended or adjusted under 35 U.S.C. 154(b) by 198 days.

(21) Appl. No.: 10/759,082

(22) Filed: Jan. 20, 2004

(65) Prior Publication Data

US 2005/0155913 A1 Jul. 21, 2005

(51) Int. Cl.
*B07C 5/04* (2006.01)

(52) U.S. Cl. ..... 209/373; 209/534

(58) Field of Classification Search ..... 209/373, 209/374, 417, 534, 680; 193/DIG. 1; D99/34, D99/35; 453/3, 63; 206/0.8, 0.81, 0.84
See application file for complete search history.

(56) References Cited

U.S. PATENT DOCUMENTS

| | | | | |
|---|---|---|---|---|
| 2,345,781 | A * | 4/1944 | Wiedemann | 273/138.5 |
| 2,519,357 | A * | 8/1950 | Daugherty | 194/288 |
| 3,338,250 | A * | 8/1967 | Mehelich | 453/9 |
| 3,593,881 | A | 7/1971 | Paap | |
| 3,675,816 | A | 7/1972 | Bourke, II et al. | |
| D241,866 | S * | 10/1976 | Miyazaki | D99/35 |
| 4,177,986 | A | 12/1979 | Campbell | |
| 5,827,117 | A * | 10/1998 | Naas | 453/9 |
| D403,833 | S * | 1/1999 | Mertins, Jr. | D99/34 |
| 5,864,289 | A | 1/1999 | Tiemann | |
| 6,017,270 | A | 1/2000 | Ristvedt et al. | |
| 6,209,765 | B1 | 4/2001 | King | |
| D470,992 | S * | 2/2003 | Perkitny et al. | D99/37 |
| D491,335 | S * | 6/2004 | Nwadike | D99/34 |
| 2003/0111395 | A1 | 6/2003 | Aas et al. | |

FOREIGN PATENT DOCUMENTS

EP 1 254 612 A1 11/2002

OTHER PUBLICATIONS http:/www/barproducts.com/newahop/index.html?target=Bartending Tools.html, Sep. 24, 2003, 1 page.
http://www.bottlesup.info/product.asp?0=244&1=24573=399, Sep. 24, 2003, 2 pages.
http://www.bardevils.com/ib/p21-04.htm, Sep. 24, 2003, 1 page.

* cited by examiner

*Primary Examiner*—Joseph C. Rodriguez
(74) *Attorney, Agent, or Firm*—Richard C. Litman

(57) ABSTRACT

A tip jar having an open necked portion and a cylindrical body portion with an upper and a lower separable section for separating paper currency from coins. The upper separable section has a centered conical portion with its peripheral base attached to the wall of the upper separable section and has peripheral coin receiving apertures alternating with raised coin deflectors adjacent the wall. The lower separable section has a closed bottom. The lower section, the upper section, and the neck portion are connected together by threading regions. The outer surface of the necked portion has an insert window guide for insertion of an advertisement sheet including a centered oval thumb slide opening to facilitate the removal of the sheet. A plurality of light emitting diodes can be positioned proximate the bottom of the jar and energized by battery to attract attention.

8 Claims, 4 Drawing Sheets

BARTENDER'S TIP JAR

BACKGROUND OF THE INVENTION

1. Field of the Invention

The present invention relates generally to jars. More specifically, the invention is a tip collection jar adapted to attract and aid bartenders in the separation and removal of coin and paper currency.

2. Description of the Related Art

The relevant art of interest describes various money receiving devices, but none discloses the present invention. There is a need for an economical simplified coin and currency receiving container that can be placed on a drinking bar for the collection of tips left by the customers. The related art will be discussed in the order of perceived relevance to the present invention.

http://www.barproducts.com/newahop/index.html?target=Bartending Tools.html is an Internet website that features a clear plastic carafe with a removable black plastic bottom, Sep. 24, 2003, 1 page. The carafe is distinguishable for requiring only two parts and a removable black plastic bottom cap.

http://www.bottlesup.info/product.asp?0=244&1=245&3=399 is an Internet website that shows a clear plastic tip jar with a black plastic removable bottom cap, Sep. 24, 3003, 2 pages. The jar is distinguishable for requiring only two parts and a removable black plastic bottom cap.

http://www.bardevils.com/lb/p21-04.htm is a website that shows a tip jar including a paper currency along with four other items such as clipboards and filing boards for a bar, Sep. 3, 3003, 1 page. The jar is distinguishable for being unclear whether the bottom is detachable.

U.S. Patent Application Publication No. US 2003/0111395 A1 published on Jun. 19, 2003, for Per Christian Aas et al. describes an automated apparatus for receiving and distributing currency from multiple countries and multiple denominations. The apparatus is distinguishable for requiring the identification, receiving and delivery of various national currencies and denominations.

U.S. Pat. No. 3,593,881 issued on Jul. 20, 1971, to Alton E. Paap describes a time and money controlled money vending-depository device that will vend packages of money, as coins in a roll or paper currency in containers, in combination with an integrated alarm means. The device is distinguishable for requiring alarm means and vending of money.

U.S. Pat. No. 3,675,816 issued on Jul. 11, 1972, to Edgar R. Rourke, II et al. describes a currency dispensing apparatus comprising the dispensing of variable amounts of currency upon reading the submitted identification card. The apparatus is distinguishable for requiring a machine for dispensing currency.

U.S. Pat. No. 5,864,289 issued on Jan. 26, 1999, to Kimberly D. Tiemann describes a coin carrier comprising a cup holder, a Teflon hinged lid having an audible open lid altering mechanism, and an adjustable length support strap assembly. The cup holder includes a central coin cup receiving cavity and a logo display area. The device is distinguishable for requiring a significantly different structure including a carrying strap, an audible open lid altering mechanism, a coin cup cavity, a lid securing hook and pile fastener, and at least one closable side pocket carried on an exterior wall.

U.S. Pat. No. 6,017,270 issued on Jan. 25, 2000, to Victor G. Ristvedt et al. describes a coin sorter machine comprising a plurality of side-by-side V-shaped elongated and sloped tracks fed from a common coin feeder. The tracks are terminated at their lower ends by coin diverters varied in configuration to progressively divert and sort coins in a descending order of diameter. The apparatus is distinguishable for being limited to a coin sorting machine requiring parallel coin receiving tracks.

U.S. Pat. No. 6,209,765 B1 issued on Apr. 3, 2001, to Patricia A. King describes a coin-holder accessory device comprising an adjustable waist belt that is lockable and having a strip portion attached that has a pressure sensitive adhesive on its obverse surface for securing a coin-cup. The device is distinguishable for being limited to a coin-cup holder assembly.

U.S. Pat. No. 4,177,986 issued on Dec. 11, 1979, to Gene E. Campbell describes a coin drop game comprising an octagonal-shaped cylinder having a coin receiving slot on top, a pair of external handles for moving an adjustable coin receiving cup mounted inside in water. The game structure is distinguishable for requiring a one-piece octagonal cylinder and movable handles.

European Patent Office Patent Application Publication No. EP 1 254 612 A1 published on Nov. 6, 2002, for Andreas Stadler describes a container for holding coins of the Euro currency comprising compartments for the six cent coins arranged in rows of three on either side of the container with the compartments for the two Euro coins arranged in between. The container has a trapezoidal shape having inward-curving sides and rounded corners. The device is distinguishable for being limited to collection of only coins in requiring compartments for six-cent coins and Euro coins.

None of the above inventions and patents, taken either singly or in combination, is seen to describe the instant invention as claimed. Thus, a bartender's jar solving the aforementioned problems of separating paper currency from coins is desired.

SUMMARY OF THE INVENTION

The bartender's jar is an extruded plastic bottle having an open necked portion and a cylindrical body portion having two separable sections for inherently separating the paper currency from the coins. The uppermost separable necked section is adjacent a centered cone with its apex pointed up and having its peripheral base attached to the middle bottle section. The conical portion has 1.125-inch diameter holes alternating with raised triangular (isosceles) coin deflectors, wherein each deflector having a ⅜ inch base around its periphery adjacent the bottle wall. The bottle sections are connected together by threaded regions. The outside bottle surface of the uppermost necked portion has a curved rectangular promotional insert window guide for inserting an advertisement sheet of a beer brand, bar name and the like having a centered oval thumb slide opening to facilitate removal of the sheet. At least one Light Emitting Diode (L.E.D.) is placed proximate the bottom of the tip jar and energized by a connected encased battery source.

Accordingly, it is a principal object of the invention to provide a bar tip collection jar according to the present invention.

It is another object of the invention to provide a bar tip collection jar having three interlocking portions to separate paper currency from coins according to the present invention.

It is a further object of the invention to provide a bar tip collection jar having an internal conical portion having coin holes alternating with raised coin deflectors at its periphery according to the present invention.

Still another object of the invention is to provide a bar tip collection jar having an external promotional insert window on one side and a logo imprint area on the opposite side according to the present invention.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is directed to at least one L.E.D. (Light Emitting Diode) on a bartender's tip collection jar placed on the bar counter for collection of pecuniary tips or gratuities for efficient service to the drinking customer. Rather than an open dish for collecting tips, this lighted jar collects coins and paper currency and separates them efficiently in an open jar. The jar is shaped externally like a juice carafe with a removable advertisement insert card on one side held in a display window open on top and with a logo imprint area for product branding on its opposite side. However, this tip collecting jar has three separable parts. If the paper currency collected interferes with collection of the coins in the bottom of the jar, the bartender can periodically shake the jar to enable the coins to drop to the jar bottom. If shaking the jar is unsuccessful, the jar can be readily dismantled.

Figure 1:
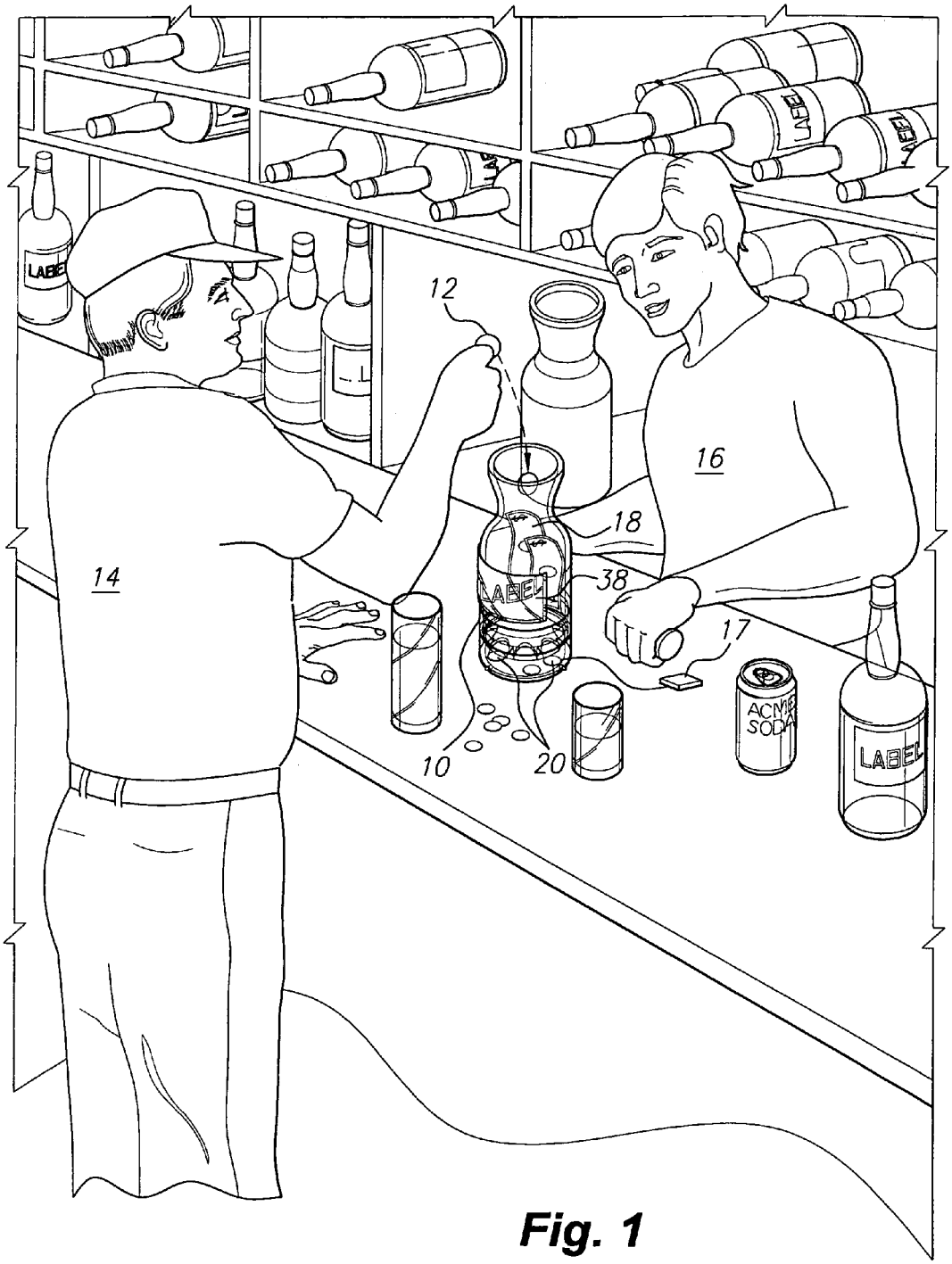
FIG. 1 is an environmental, perspective view of a bartender's tip jar on a bar counter according to the present invention.
Figure 2:
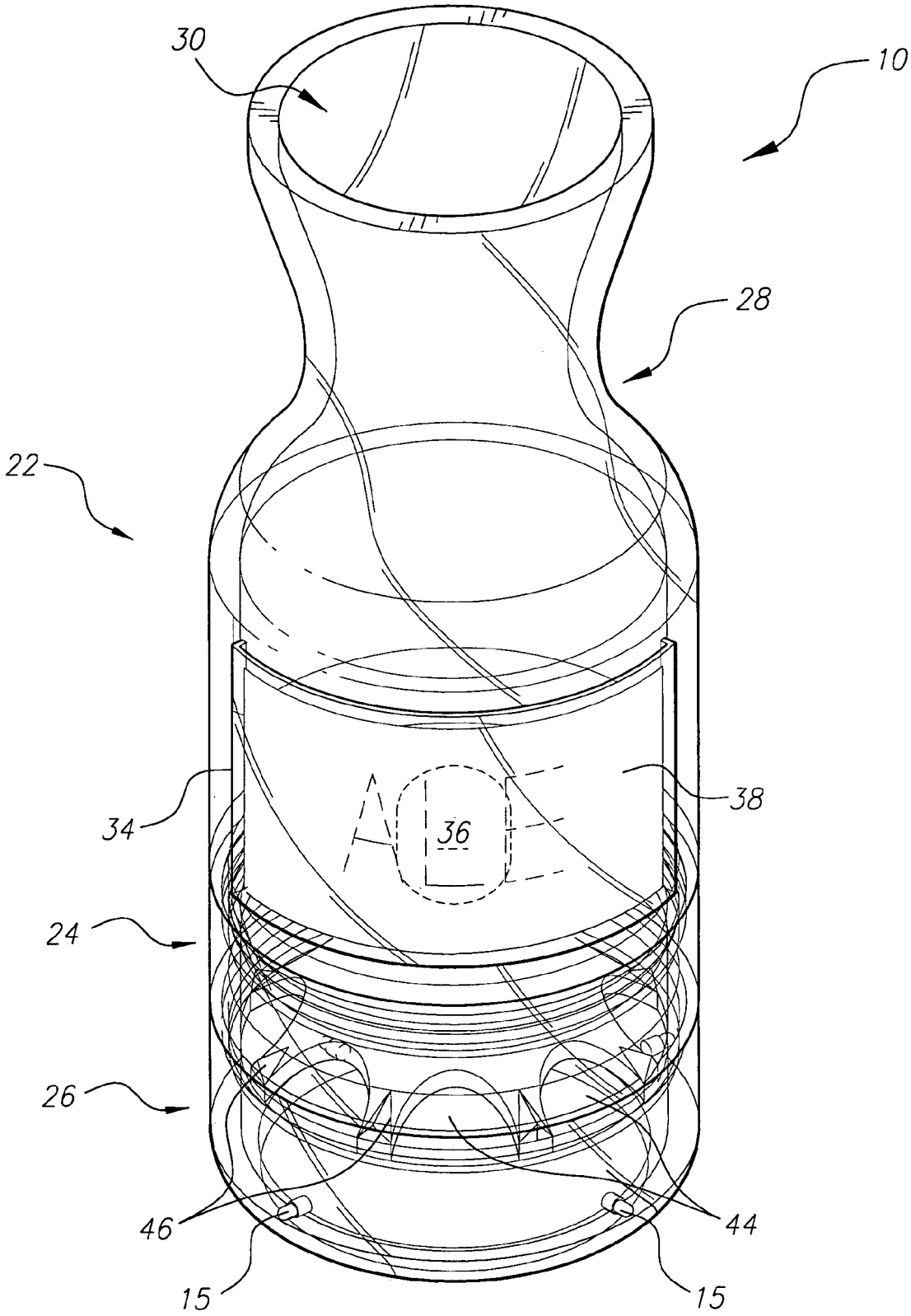
FIG. 2 is a perspective front view of the integrated tip jar having a display insert window and four LED's according to the present invention.
Figure 3:
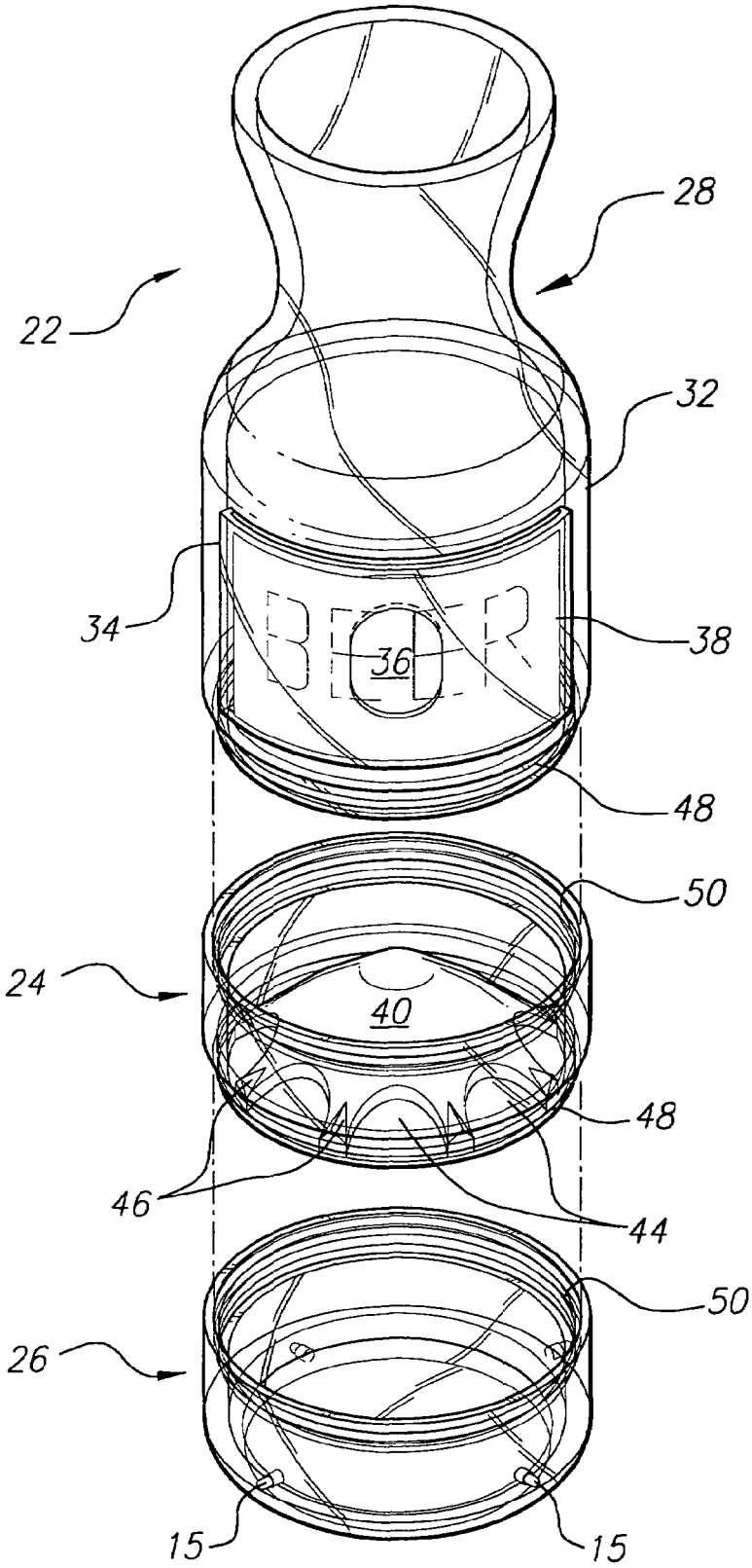
FIG. 3 is an exploded perspective front view of the tip jar illustrating the three portions and the insert display window having an extending insert on the upper jar portion according to the present invention.
Figure 4:
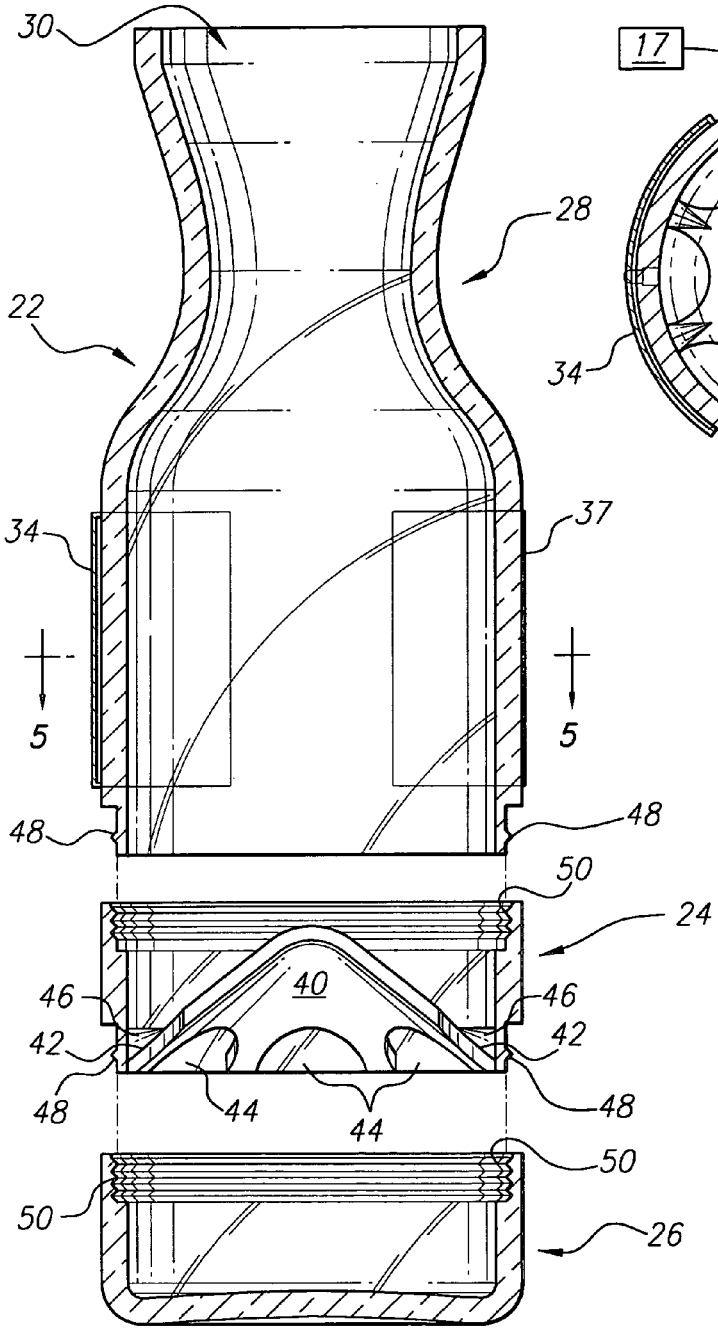
FIG. 4 is an exploded cross-sectional side view of the tip jar illustrating the display window on the upper jar portion according to the present invention.
Figure 5:
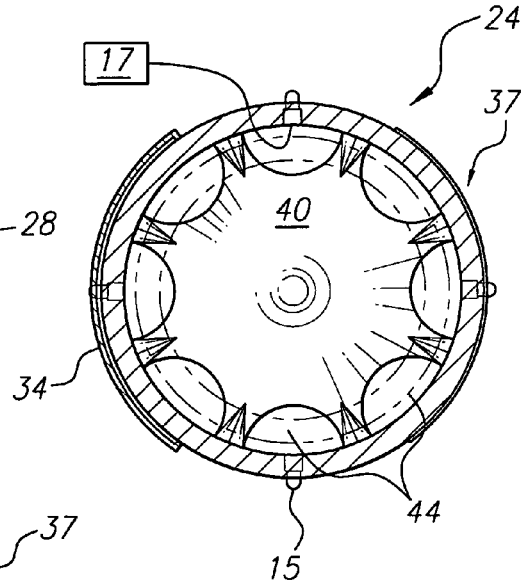
FIG. 5 is a bottom plan view of the middle and bottom sections of the tip jar with the neck portion shown in dashed lines according to the present invention.

In FIG. 1, the bartender's tip collection jar 10, hereafter referred to as the jar, has a coin 12 tossed into the jar 10 already containing paper currency 18 by a customer 14 that is appreciated by the bartender 16. An L.E.D. 15 having any color such as red, green and the like is attached near the bottom of the jar 10 and energized by a encased battery 17.

FIGS. 2 through 5 illustrate the various parts of the jar 10 that contribute to the efficiency of the collection jar for removing the separated paper currency 18 from the coins 20. The three separable parts are the neck portion 22, the middle portion 24, and the bottom portion 26. These portions are made by extrusion of transparent plastic.

The neck portion 22 has a reduced diameter neck 28, an opening 30, and a cylindrical part 32 having the same diameter as the remaining parts of the jar 10. A transparent rectangular insert window 34 in front having a centered oval opening 36 (FIGS. 2 and 3) is added to the jar part 32 for inserting a promotional label 38 shown in FIG. 1. The label 38 can be an advertisement of a specific alcoholic beverage such as "ALE". The insert window 34 is only open on top for the insertion and removal of the label 38. A centered oval opening 36 in the insert window 34 assists in the removal of the label 38. A logo imprint area 37 is located on the jar 10 opposite the insert window 34 (FIG. 4) for product logo branding and the like.

The opposite side of the tip jar 10 can be used to post a beer company label and the like.

The middle portion 24 is the functional separation stage of the paper currency 18 from the coins 20, and consists of a centered upright truncated cone 40 with its periphery or the bottom edge 42 joined to the wall of the middle portion 24. The cone 40 has semicircular holes 44 alternating with raised triangular coin director elements 46. The coin director elements 46 deflect or guide the coins of various sizes into the holes 44 due to their triangular shape with the apex directed inward.

The bottom portion 26 collects the coins 20. Any coins caught in the middle portion 24 due to interference of any paper currency 18 can be allowed to pass through the holes 44 by merely shaking the jar 10.

The neck portion 22 has an external threaded region 48 that threads with the internal threaded region 50 on the top region of the middle portion 24. Similarly, the bottom threaded region of the middle portion 24 is an external threaded region 48 that meshes with the internal threaded region 50 of the bottom portion 26 of the jar 10. Thus, the three parts of the jar 10 can be readily separated for retrieval of the tips inserted and separated between the paper currency and coins.

An exemplary tip jar's approximate dimensions will be presented as follows:

Height: 11 inches.

Outside Diameter: 4.25 inches.

Thickness of wall: 0.25 inch.

Opening 30 of jar: 3 inches.

Inside diameter of narrow portion of neck portion: 2 inches.

Promotional insert window 34: 4 in. wide and 3 in. height.

Centered oval opening 36 in window 34: 1 in. wide, 1.5 in. in height.

Cone 40: 1.5 in. height; 0.125 in. thick; 3.75 in. wide; apex 0.5 in. inside radius.

Semicircular holes 44: 1.125 in. diameter; 8 holes.

Threaded regions 48, 50: 0.5 in. in height.

Raised triangular coin director elements 46: 0.25 in. horizontal length; 0.25 in. vertical height; 8 elements.

Thus, an efficient, effective illuminated bartender's tip jar has been shown that can separate the paper currency from the coins deposited and be opened to retrieve the tips separately.

It is to be understood that the present invention is not limited to the embodiment described above, but encompasses any and all embodiments within the scope of the following claims.

We claim:

1. A bartender's jar, comprising:

an extruded translucent plastic jar having an open necked portion and a cylindrical body portion having two separable engaging first and second sections;

said first separable section containing a centered upright cone with its periphery joined to the inside bottom edge of said first separable section;

said inside bottom edge having holes alternating with raised triangular coin director portions; and said second separable section having a closed bottom;

whereby introduction of paper currency and coins into the bartender's jar are separated by the coins passing through the holes to the bottom of the bartender's jar.

2. The bartender's jar according to claim 1, wherein the open necked portion, the first separable section and the closed bottom section include threaded grooves for connecting together said portion and sections.

3. The bartender's jar according to claim 1, wherein the coin holes are semicircular and allow the largest coin to pass.

4. The bartender's jar according to claim 1, wherein a rectangular transparent insert window frame having a top opening and a centered cutout is positioned on one side of the jar's neck portion for insertion of a promotional marketing label.

5. The bartender's jar according to claim 4, wherein the window frame has a centered oval opening for enabling the removal of the promotional marketing label.

6. The bartender's jar according to claim 1, wherein a logo imprint area is positioned on an opposite side of the jar's neck portion for a product logo branding.

7. The bartender's jar according to claim 1, further including at least one light emitting diode positioned on the jar and energized by a proximate battery.

8. The bartender's jar according to claim 7, wherein four light emitting diodes are equally spaced on a bottom jar portion.

* * * * *